US008511487B2

(12) United States Patent
Andersen et al.

(10) Patent No.: US 8,511,487 B2
(45) Date of Patent: Aug. 20, 2013

(54) SHELF ASSEMBLY

(75) Inventors: John Andersen, Fredrikstad (NO); Håkan Sjölander, Bräcke (SE)

(73) Assignee: Enjoy Group AB, Bracke (SE)

( * ) Notice: Subject to any disclaimer, the term of this patent is extended or adjusted under 35 U.S.C. 154(b) by 376 days.

(21) Appl. No.: 12/514,500

(22) PCT Filed: Nov. 13, 2007

(86) PCT No.: PCT/SE2007/001002
§ 371 (c)(1),
(2), (4) Date: Jan. 5, 2010

(87) PCT Pub. No.: WO2008/060222
PCT Pub. Date: May 22, 2008

(65) Prior Publication Data

US 2010/0176074 A1 Jul. 15, 2010

(30) Foreign Application Priority Data

Nov. 13, 2006 (SE) ..... 0602400

(51) Int. Cl.
*A47F 5/02* (2006.01)

(52) U.S. Cl.
USPC ..... 211/144; 211/163; 312/305

(58) Field of Classification Search
USPC ..... 211/144, 59.2, 163; 312/125, 135, 312/207.2, 298, 305, 317.2; 248/345.1
See application file for complete search history.

(56) References Cited

U.S. PATENT DOCUMENTS

| | | | | | |
|---|---|---|---|---|---|
| 1,603,127 | A | | 10/1926 | Lombardo | |
| 2,035,226 | A | | 3/1936 | Forsthoefel | |
| 2,344,650 | A | * | 3/1944 | Sloat | 211/78 |
| 2,647,812 | A | * | 8/1953 | Saunders | 312/294 |
| 2,813,635 | A | * | 11/1957 | Schumacher | 108/138 |
| 2,840,438 | A | * | 6/1958 | Sharpe | 312/322 |
| 3,693,807 | A | * | 9/1972 | Larson | 211/163 |
| 4,113,110 | A | * | 9/1978 | Mittag | 211/191 |
| 4,300,809 | A | * | 11/1981 | Brownlee | 312/305 |
| 4,587,908 | A | * | 5/1986 | DeBruyn | 108/142 |
| 5,240,124 | A | * | 8/1993 | Buday | 211/59.2 |
| 5,289,656 | A | * | 3/1994 | Vetter | 49/250 |

(Continued)

FOREIGN PATENT DOCUMENTS

| | | |
|---|---|---|
| EP | 0 577 551 A1 | 1/1994 |
| EP | 1 683 449 A1 | 7/2006 |
| EP | 1 749 461 A1 | 2/2007 |

*Primary Examiner* — Korie H Chan

(74) *Attorney, Agent, or Firm* — Birch, Stewart, Kolasch & Birch, LLP

(57) ABSTRACT

A shelf assembly for products to be placed in a limited space, which at least is limited in depth by a rear boundary surface and laterally by lateral surfaces. The shelf assembly consists of a shelving section with a front and a rear, which shelving section comprises a plurality of gravity-feeding shelves and a base plate. The shelving section is placed on a shelving section support and arranged on the same to be rotatable about an axis, which is arranged by a first engaging means, which is placed on the base plate and rotatably engaged with a second engaging means, which is placed on the shelving section support. The rear of the shelving section is in the refill position located further away from the rear boundary surface than is the front of the shelving section in the display position. Moreover, the shelving section is rotatable substantially within the limited space.

13 Claims, 7 Drawing Sheets

(56) References Cited

U.S. PATENT DOCUMENTS 6,086,171 A * 7/2000 Ashley et al. ..... 312/97.1
6,955,271 B1 * 10/2005 Stallings ..... 211/144
7,587,790 B2 * 9/2009 McCue et al. ..... 16/404
2007/0048112 A1 3/2007 Andersen et al.

* cited by examiner 514
514
512
500

516
502
502
515

SHELF ASSEMBLY

FIELD OF THE INVENTION

The present invention relates generally to a shelf assembly for products and, more specifically, to a shelf assembly with gravity-feeding shelves to be placed in a limited space, which shelf assembly is rotatable between at least one display position, in which the shelves are accessible from the front of the shelving section, and a refill position, in which the shelves are accessible from the rear of the shelving section.

BACKGROUND ART

In supermarkets and department stores there are many different types of shelf assemblies, which are filled with products offered for sale. Many of these products must for various reasons, such as open-dating or refrigerating reasons, be supplied in such a manner that the last supplied products are positioned in the rear part of the shelf. At the same time this satisfies the requirement that the product first supplied is also first sold. A large amount of the time of the shop staff is used to supply additional products. This means that there is a great interest in getting rid of conventional types of shelf assembly where the remaining products from previous supplies first must be removed from the shelf assemblies before supplying new products. One way of solving this problem is to design shelf assemblies which are adapted to be refilled from behind. This can be achieved by wheels being mounted on the shelf assemblies so that the shelf assembly is completely pulled out, or alternatively pivoted out, from its position to make the rear accessible for refilling. Since the shelf assemblies are in many cases quite heavy and difficult to steer, it may be necessary to take care of this by using supports and/or guide tracks which guide the movement, like in shelf assemblies in refrigerators according to European patent application 1683449 A1.

A certain drawback of this type of solution is that some shops are limited in respect of space in aisles. It causes inconvenience to customers and staff that the aisles are blocked by shelf assemblies when supplying additional products. The staff will then be inclined not to pull out the shelf assembly, and therefore the construction will not be used as intended.

SUMMARY OF THE INVENTION

An object of the present invention is to provide an improved solution for a shelf assembly which can be refilled from behind without suffering from drawbacks indicated in connection with prior art.

The above object is achieved by a shelf assembly according to the invention.

More specifically, according to one aspect to the present invention a shelf assembly is provided for products, which is adapted to be placed in a space, which at least is limited in depth by a rear boundary surface and laterally by lateral surfaces. The shelf assembly has a shelving section with a front an a rear, which shelving section comprises a plurality of spaced-apart gravity-feeding shelves, which are arranged above each other. The shelving section is rotatable about a vertical axis of rotation between at least one display position, in which the shelves are accessible from the front of the shelving section, and a refill position, in which the shelves are accessible from the rear of the shelving section. The shelf assembly further comprises a shelving section support placed on the base, and the shelving section comprises a base plate. Moreover the shelving section is placed on the shelving section support. The axis of rotation extends through a first engaging means which is arranged on the underside of the base plate and which is rotatably engaged with a second engaging means which is arranged on the upper side of the shelving section support. The rear of the shelving section is in the refill position located further away from said rear boundary surface than is said front of the shelving section in the display position. Further the shelving section is rotatable substantially within the limited space.

As a result, a shelf assembly is provided, which can be rotated between a display position and a refill position in situ in a limited space about an axis of rotation and whose shelving section's rear in the refill position is located further away from the rear boundary surface of the limited space than is the front of the shelving section in the display position. This facilitates refilling of the shelf assembly from behind. The rear of the shelf assembly is not only facing the person who is to supply additional products but also has a small projecting portion so that, for refilling, the person does not have to reach into the limited space. In addition, the floor surface in front of the limited space is not occupied by the shelving section in refilling.

In one embodiment of the shelf assembly, the first engaging means, and thus the position of the shelving section, is movable in depth between a first position and a second position relative to the shelving section support, the first position corresponding to the display position and the second position corresponding to the refill position. This difference between the first and the second position corresponds at least to the distance in depth between the pivot radius of the shelving section and the rear of the shelving section in the display position.

This results in a shelf assembly, which makes it possible for a rotation of the shelving section from the display position to the refill position to occur in a limited space by the axis of rotation being moved so that the pivot space available in the space corresponds to the pivot radius of the shelving section. This produces the advantage that a shelving section which in fact is too large to be rotated in the space can obtain sufficient space to move in order to rotate from the display position to the refill position. A corresponding movement back to the original position of the axis of rotation during rotation back to the display position from the refill position resets the position of the shelving section in the space. In the refill position, the rear of the shelving section is made accessible for refilling. The shelving section then protrudes from the front edge of the space. This is advantageous when the shelves are to be supplied with products.

In one embodiment of the shelf assembly, the axis of rotation in the lateral direction is arranged substantially centrally while the axis of rotation in depth is arranged closer to the front of the shelving section than the rear of the shelving section, the axis of rotation substantially coinciding with the centre of a geometric circle, whose diameter corresponds to the width of the space and is tangent to the lateral surfaces and the rear boundary surface of the space.

This results in a shelf assembly which by asymmetric location of a stationary axis of rotation can rotate in a limited space where the pivot radius of the shelf assembly in one embodiment according to prior art would prevent rotation from the display position to the refill position in the space. A further advantage of the asymmetric location of the stationary axis of rotation is that in the refill position the shelving section protrudes from the limited space and facilitates refilling of the shelf assembly.

In one embodiment of the shelf assembly, the second engaging means is a groove, in which the first engaging means can move. This is a solution which both stabilises the rotation and limits the degree of freedom of the movement.

In one embodiment, a gear wheel is arranged on the first engaging means, which gear wheel meshes with a gear rack arranged on the shelving section support, the gear rack positions of the gear wheel corresponding to different movements of the axis of rotation in depth. This means that the movement of the axis of rotation, forward and backward in depth, is controlled while the shelving section is being rotated between the display position and the refill position.

To facilitate the rotation of the shelving section, roller means are arranged on the underside of the base plate in one embodiment of the invention. In an alternative embodiment of the invention, roller means are also/instead placed on the upper side of the shelving section support. These roller means may be, for instance, wheels, but should not be restricted thereto.

In another embodiment, the roller means are arranged substantially in a circle, but also other ways of placing the wheels are conceivable and not excluded by this example.

The design of the shelves of the shelf assembly can be performed in various ways. In one embodiment, gravity feeding is achieved by letting the shelves be inclined. Gravity feeding means that the products on the shelf slide forward to the front edge of the shelf, for instance during refilling or when a vacancy has occurred because a product has been removed from the front edge by a customer. The inclined shelves also produce the advantage that the centre of gravity of the shelving section in the refill position will not be positioned outside the shelving section support. The total weight of the remaining products and the last supplied products will thus be positioned closer to the front edge of the shelf assembly, which front edge in the refill position is facing the rear wall of the space.

For further improvement of the gravity feeding, the shelves are in one embodiment provided with sliding surfaces, which may be sliding tracks or roller tracks. This is also advantageous since it will be possible to easily renovate the shelf assembly by only replacing worn out sliding tracks or roller tracks with new ones instead of making the more complicated and expensive exchange of entire shelves.

In one embodiment of the shelf assembly, the shelves are provided with channels for stabilisation and advantageous exposure of advanced products.

In one embodiment of the shelf assembly, the shelving section is provided with side walls which each is a metal sheet, which metal sheet is provided with rotation- and deflection-resistant bends. This significantly improves the stability of the shelf assembly compared to a solution in which entire side plates without bends are used.

In one embodiment, the shelves are designed based on a substantially rectangular shape, the rear corners of the shelves being trimmed for optimal adjustment of the shelving section in the limited space. Trimming of the rear corners is made to assist the rotation of the shelving section while achieving a maximum total shelving surface, that is load area, relative to the available area in the space. Due to the solution according to the invention involving the asymmetric location of the axis of rotation, the front corners, however, need in principle not be trimmed, which will be explained in more detail in connection with the description of the embodiments. The shelf assembly thus uses as large a portion of the load area as possible for the shelf assembly inside the limited space while at the same time the shelf assembly with the asymmetric location of the axis of rotation is rotatable within the space. The alternative of a shelf assembly which is not designed according to the invention but, for instance, has an entirely symmetric location of the axis of rotation, would be to provide it with shelves the area and maximum pivot radius of which are substantially smaller than the area available in the space.

In one embodiment, the front edges of the shelves are straight.

In one embodiment, the space, and the shelf assembly, has a greater width than its depth. The invention is particularly advantageous with such proportions.

BRIEF DESCRIPTION OF THE DRAWINGS

The invention will now be described in more detail by way of non-limiting embodiments and with reference to the accompanying drawings. Equivalent components in the embodiments have the same reference numerals.

DESCRIPTION OF PREFERRED EMBODIMENT

Figure 1:
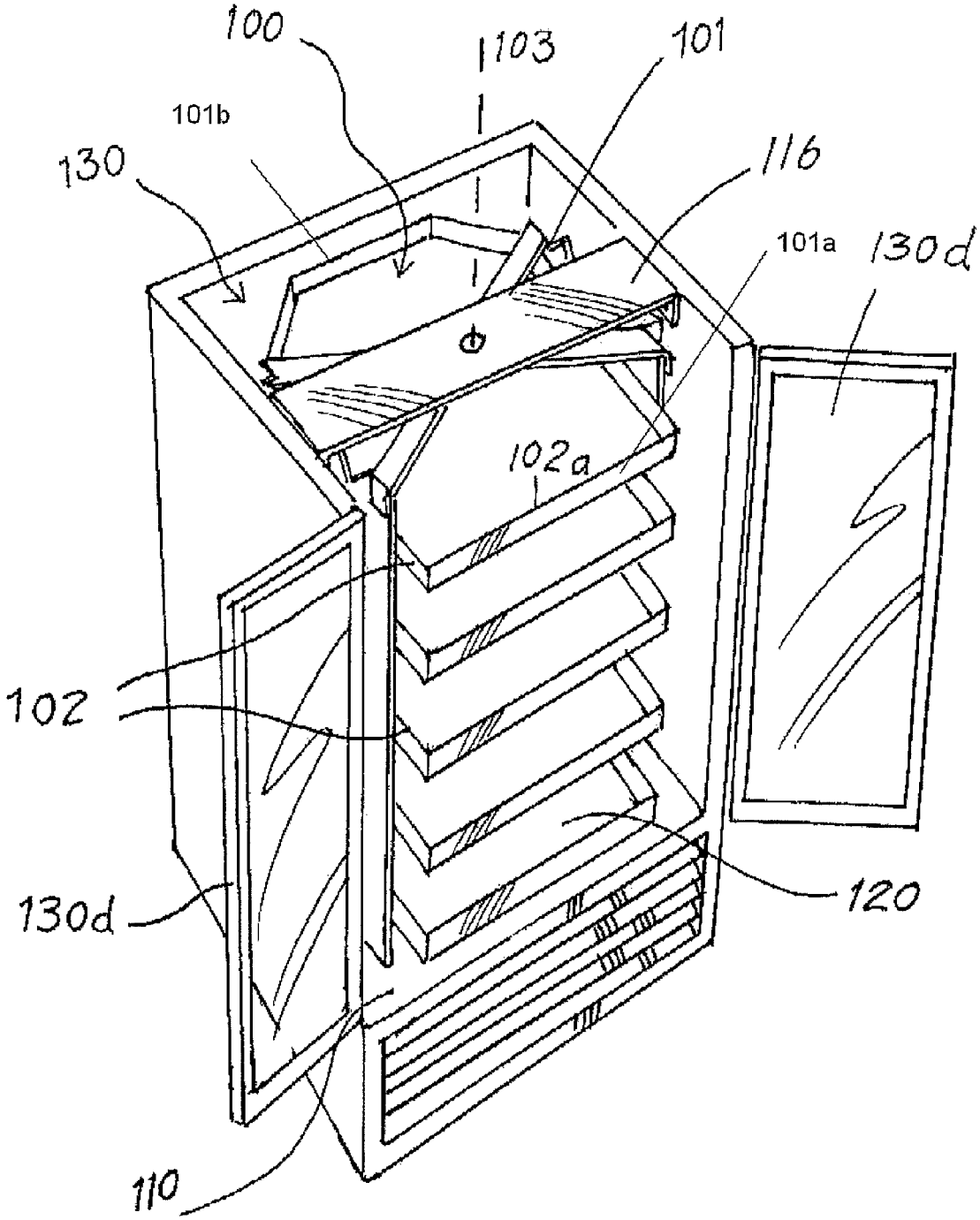
FIG. 1 illustrates an embodiment of a shelf assembly according to the invention, which shelf assembly is placed in a refrigerator.

FIG. 1 illustrates a first embodiment of the shelf assembly according to the invention. The shelf assembly 100 according to this embodiment comprises a shelving section 101 and a shelving section support 110. The shelving section 101 is arranged on the shelving section support 110, the shelving section 101 being rotatable about an axis 103. The shelving section 101 has a front 101*a* and a rear 101*b* and comprises a number of shelves 102 for products. The shelves 102 are arranged in the shelving section 101 with such an inclination that gravity feeding of products placed on the shelf is assisted. During refilling, or when a person removes products to be purchased such that a vacancy occurs along the front edge 102*a* of the shelf, the products automatically slide on the shelf 102 toward the front edge 102 of the shelf. The shelves 102 can also be provided with sliding surfaces 120, which additionally assist in gravity feeding of products since the friction between the product and the base is reduced by means of the sliding surfaces 120. The sliding surfaces 120 are preferably arranged along exchangeable sliding tracks or roller tracks.

In FIG. 1, the entire shelf assembly 100 is placed in a limited space 130, which is a refrigerator 130 with doors 130*d*. The limited space 130 may also consist of a cabinet without doors, or of walls, or consist of other juxtaposed and/or posteriorly situated shelf assemblies. Also other combinations of shelf assemblies, cabinets and walls constitute conceivable limited spaces, which are not to be excluded by the description.

Figure 2A:
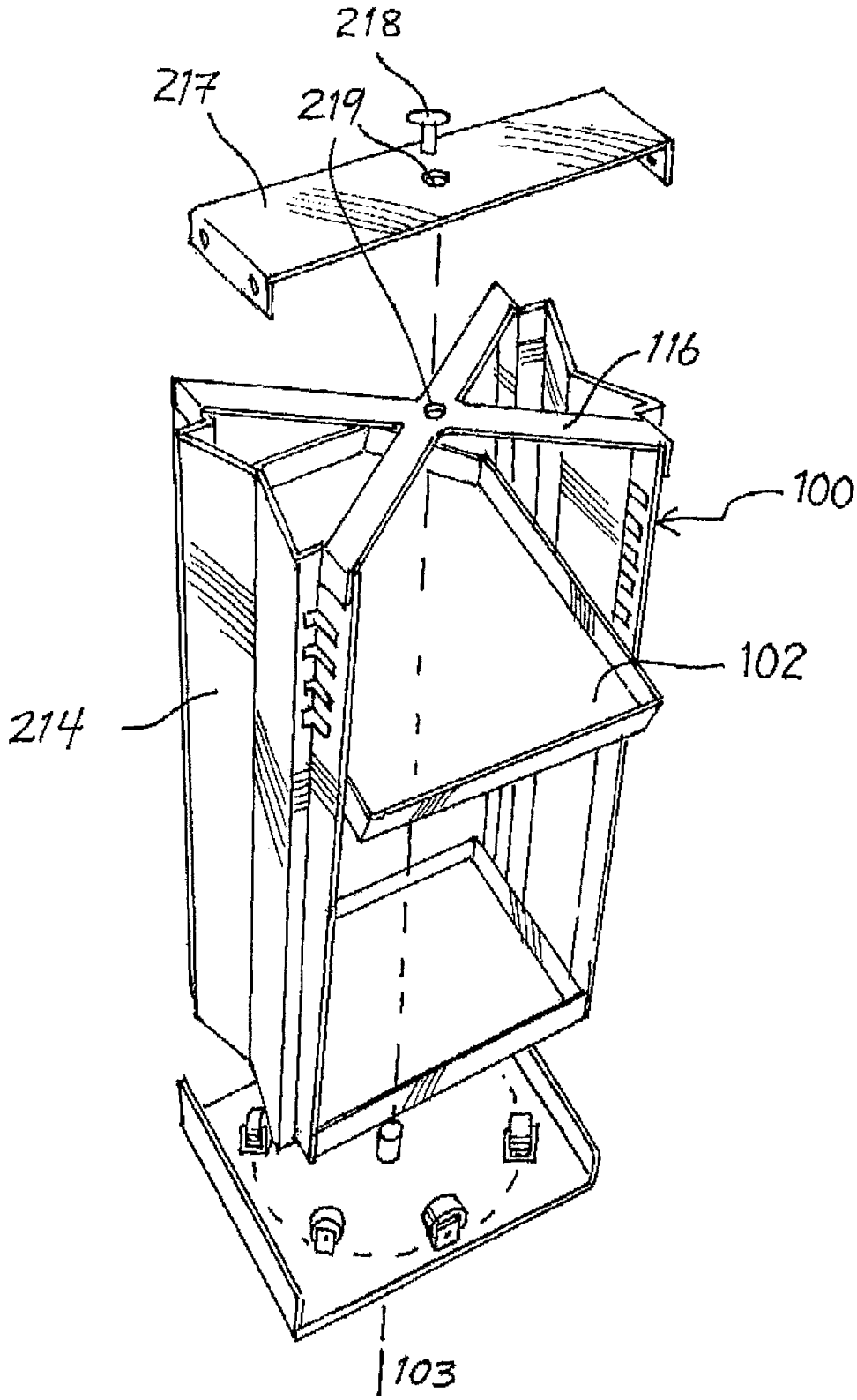
FIGS. 2*a* and *b* are exploded views which show details of an embodiment according to FIG. 1.
Figure 2B:
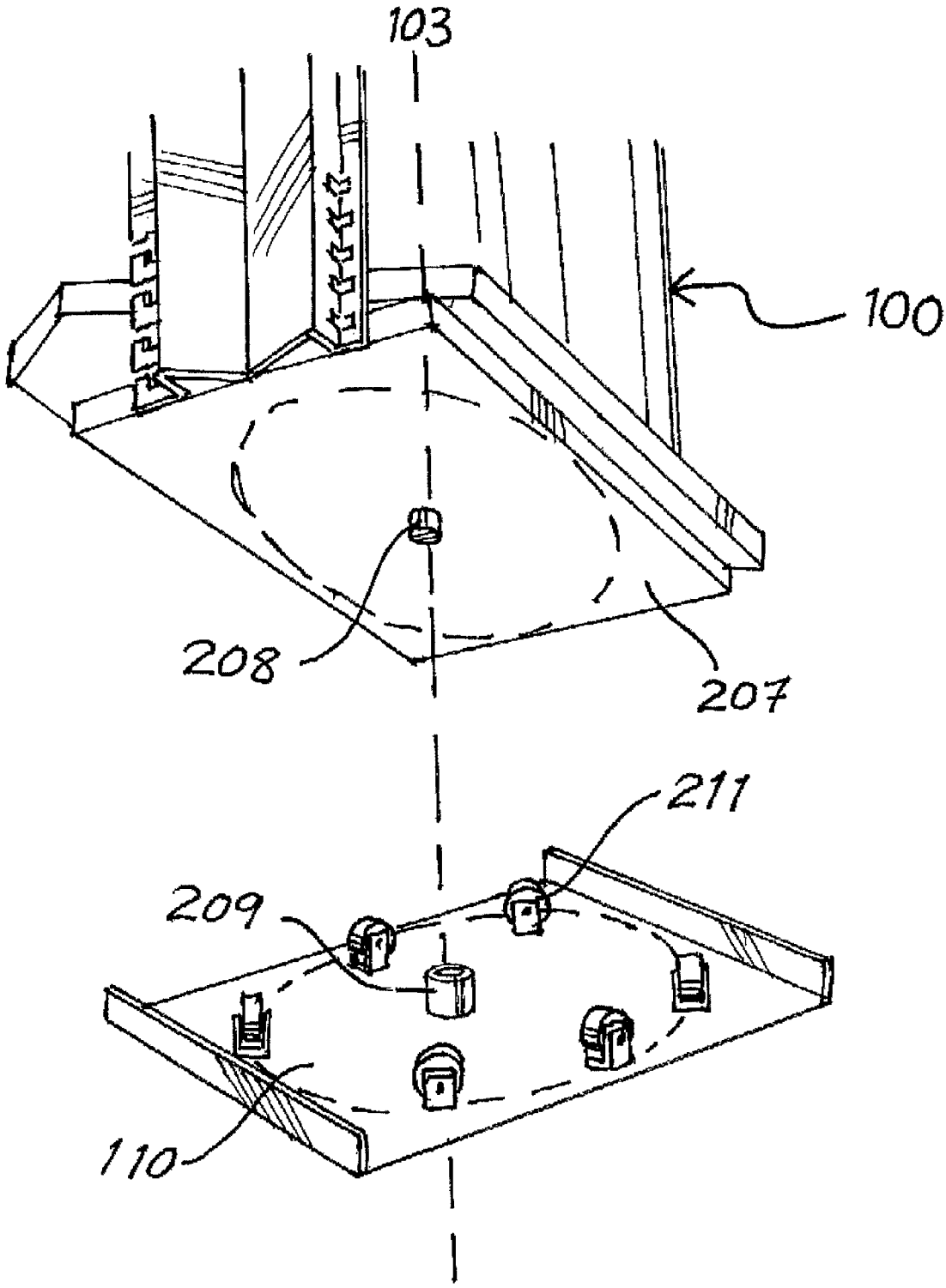

FIGS. 2*a* and 2*b* are exploded views which illustrate further details of the shelf assembly 100. The shelving section 101 comprises, in addition to the shelves 102, a base plate 207 and an upper part 116, also side walls 214. The base plate 207 has a first engaging means in the form of a shaft end 208 which engages a second engaging means arranged on the shelving section support 110 in the form of a shaft seat 209, the shaft end 208 being rotatable in the shaft seat 209.

In an alternative embodiment, the shaft end 208 and the shaft seat 209 are arranged in reverse order in such a manner that the shaft end 208 is placed on the shelving section support 110 while at the same time the shaft seat 209 is placed on the base plate 207, the shaft end 208 being rotatably engaged with the shaft seat 209.

Roller means 211, which in this embodiment are wheels 211 mounted in ball bearings, are arranged on the upper side of the shelving section support 110. As mentioned above, the wheels 211 can also be placed on the underside of the base plate 207 of the shelving section 101. The purpose of the wheels 211 is to use a plurality of contact points to stabilise the shelving section 101 and reduce the frictional force during rotation of the shelving section 110. A non-limiting example of locating the wheels 211 in an advantageous manner is to arrange them so that they together form substantially a circle along which the wheels 211 roll during rotation between the display position and the refill position.

In one embodiment according to the invention, wheels are also placed on the underside of the shelving section support 101, in which case the shelf assembly 100 is rollable.

Additional stabilisation of the shelving section 101 is provided by the upper part 116 of the shelving section 101 being provided with an extra shaft seat 219 and a support plate 217 which is externally arranged, connected to the shelving section 101, and provided with a shaft end 218. The extra shaft end 218 is in the embodiment engaged with the extra shaft seat 219 and vertically aligned with the shaft end 208 of the base plate 207 and the shaft seat 209 of the shelving section support 210 and thus constitutes a second point for the axis of rotation 103 about which the shelving section 101 is rotated between the display position and the refill position. The upper support plate 217 is adapted to be attached to the roof of the cabinet 130. In other embodiments, the support plate 217 can be attached to surrounding walls or be joined to support plates of other, neighbouring shelf assemblies.

In an alternative preferred embodiment, the shelving section 101 is rotatably suspended from the upper support plate 217. Suspension is performed by, for instance, a ball bearing/shaft, the rotation of the shelving section 101 about the axis of rotation 103 being made possible with a minimum of rotation resistance. In this embodiment, the shaft end 208 and the shaft seat 209 have a supporting function. In addition, roller means 211 can be mounted on, for instance, the base plate 207 as a support for the shelving section 101.

FIG. 3 is a top plan view of an embodiment of a shelf assembly according to the invention. In this second embodiment the shelf assembly is built in substantially the same way as the first embodiment described above. The shelf assembly 300 thus comprises a shelving section 301, with a front 301*a* and a rear 301*b*, which shelving section 301 is placed on a shelving section support and which comprises shelves 302. The shelf assembly 300 is placed in a limited space 330, which in this case is a cabinet 330. The shelf assembly 300 has an upper part which, however, for reasons of simplification is not shown in the figures.

Figure 3A:
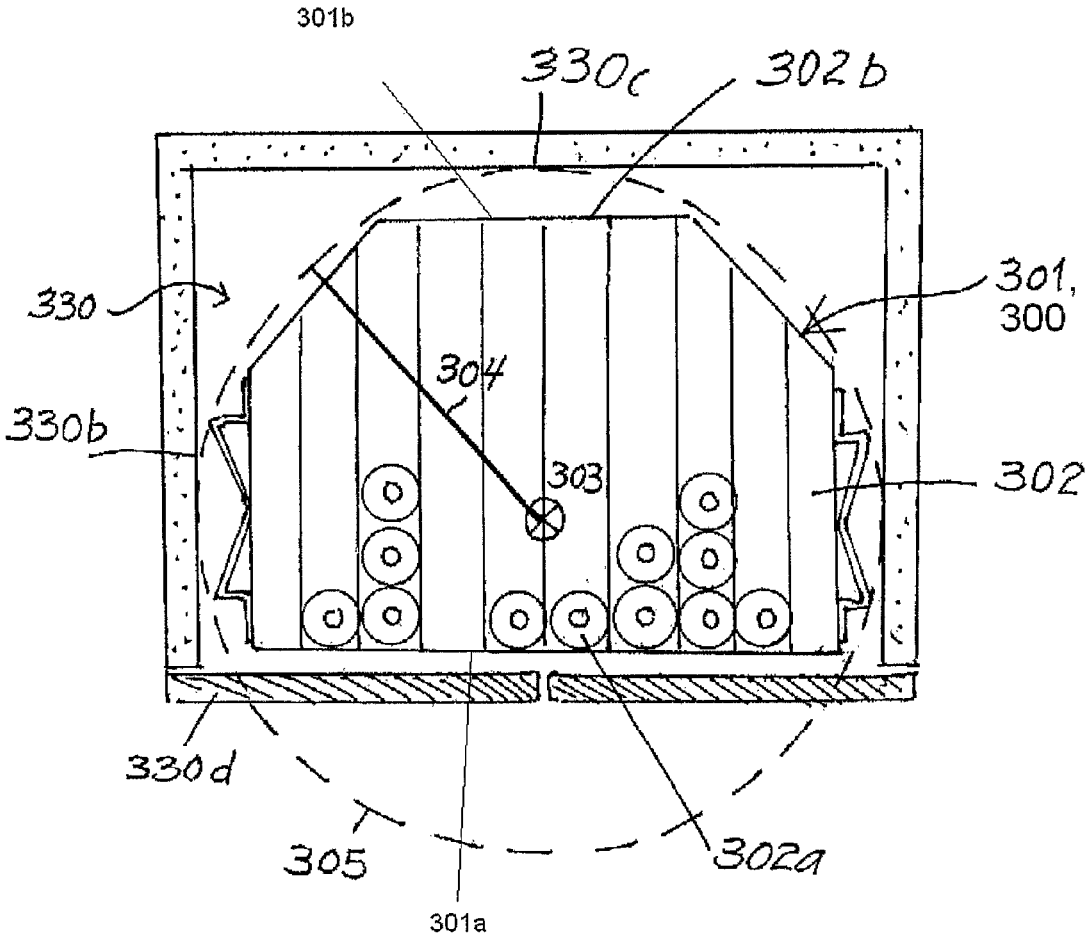
FIG. 3*a* shows a display position and 3*b* a refill position for an embodiment of a shelf assembly according to the invention.
Figure 3B:
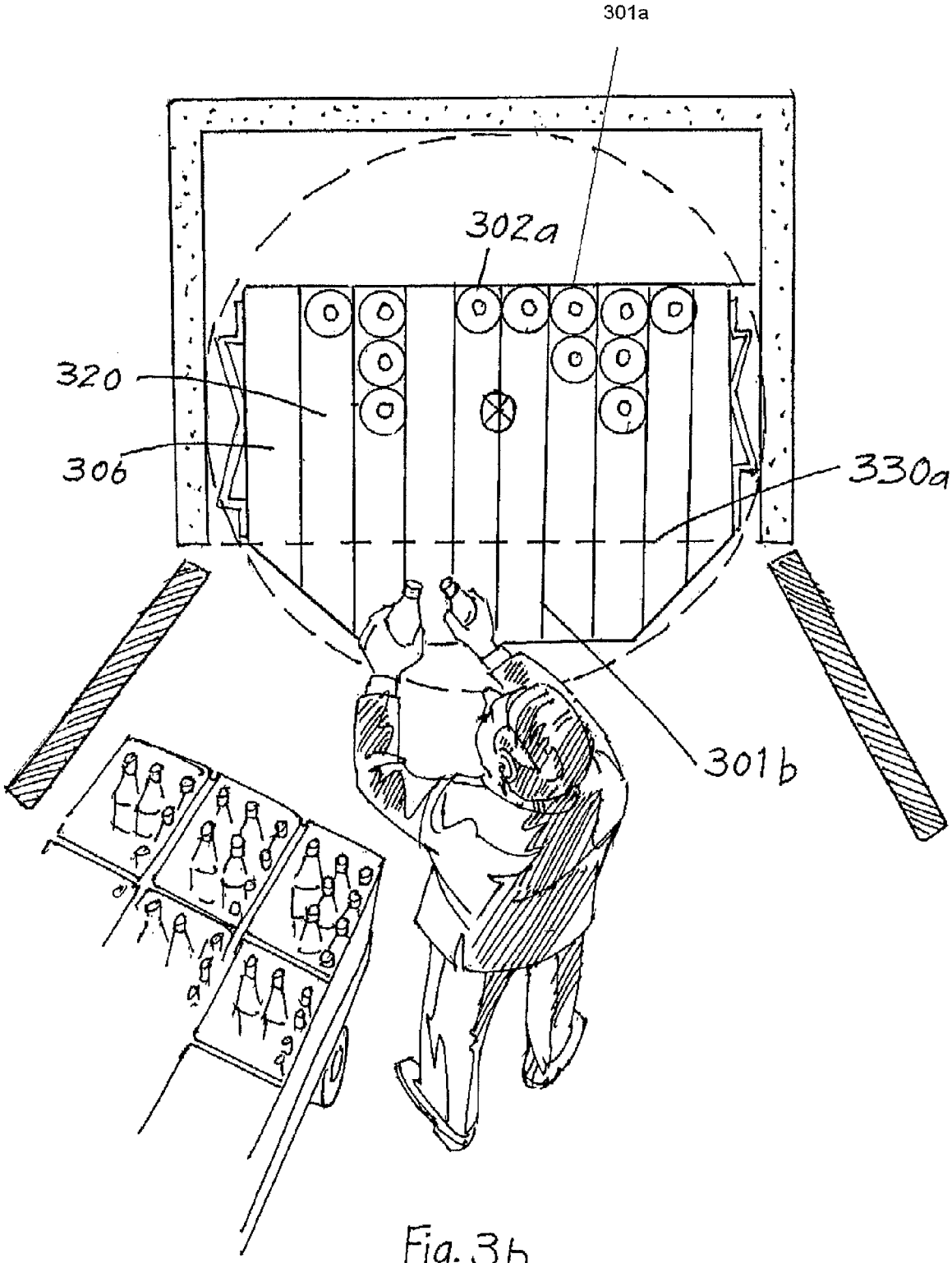

The shelving section 301 is rotatable about an axis of rotation 303, between a display position according to FIG. 3*a* and a refill position according to FIG. 3*b*. The axis of rotation 303 is asymmetrically located in relation to the centre of the shelves 302. The distance between the axis of rotation 303 and the rear edge 302*b* of the shelves is greater than the distance between the axis of rotation 303 and the front edge 302*a* of the shelves. The axis of rotation 303 coincides with the centre of a geometric circle 305 whose diameter corresponds to the width of the space 303 and is tangent to the lateral surfaces 330*b* and the rear boundary surface 330*c* of the space. This design results in the rear 301*b* of the shelving section in the refill position being further away from the rear boundary surface 330*c* than is the front 301*a* of the shelving section in the display position. The shelving section 301 is rotatable substantially within the limited space 330.

The shelves 302 are designed based on a substantially rectangular shape, the rear corners of the shelves 302 being trimmed. By trimmed is meant that the corners are, for instance, rounded, arcuate, bevelled or cut off so as to assist the rotatability of the shelving section 301 in the limited space 330. The front edge 302*a* of the shelves is straight. The design of the shelves 302, with trimmed rear corners, a straight front edge 302 and the axis of rotation 303 which as described above is asymmetrically located, is adapted to maximise the area of the shelves 302 within a boundary line which is defined by the geometric circle 305 and the doors 330*d* of the cabinet. The pivot radius 304 of the shelves 302 corresponds substantially to the radius of the geometric circle 305. In the display position, the entire shelves 302 are located in the cabinet 330. In the refill position, the rear 301*b* of the shelving section protrudes, and thus also the rear edges 302*b* of the shelves protrude, from the front edge 330*a* of the cabinet 330, which allows smooth access for supply of products also at the trimmed rear corners of the shelves 302.

In this second embodiment, the shelves 302 are divided into product channels 306. The product channels 306 are advantageous in gravity feeding of products since they support the products and allow the products to be displayed in a favourable manner. Also in this embodiment, the base of the product channels 306, or alternatively the entire upper sides of the shelves 302, can be provided with sliding surfaces 320 which assist gravity feeding of products.

A further advantage of gravity feeding as described above is that the centre of gravity of the shelving section 301 in the refill position is automatically moved toward the front edge 302*a* of the shelves, thus reducing the risk of the shelf assembly 300 tilting and falling out of the cabinet 330.

Figure 4A:
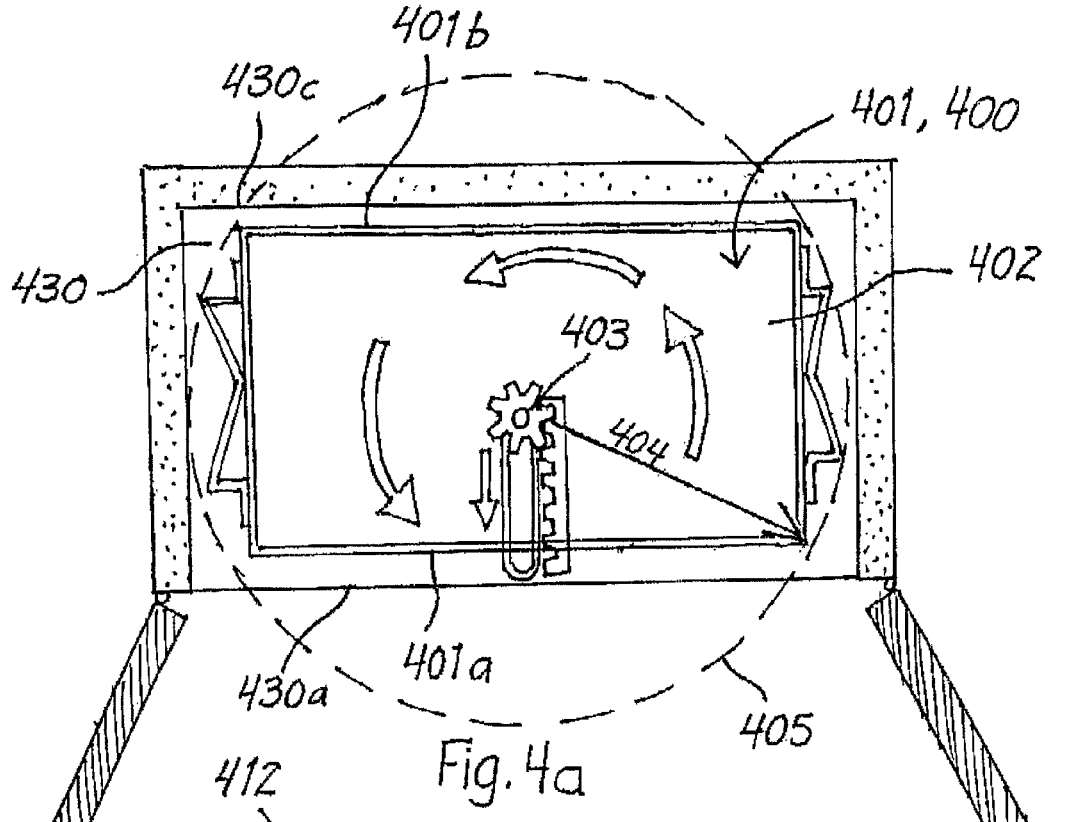
FIG. 4*a* is a cross-sectional view from above of an embodiment of a shelf assembly according to the invention, the shelf assembly being placed in a cabinet.
Figure 4B:
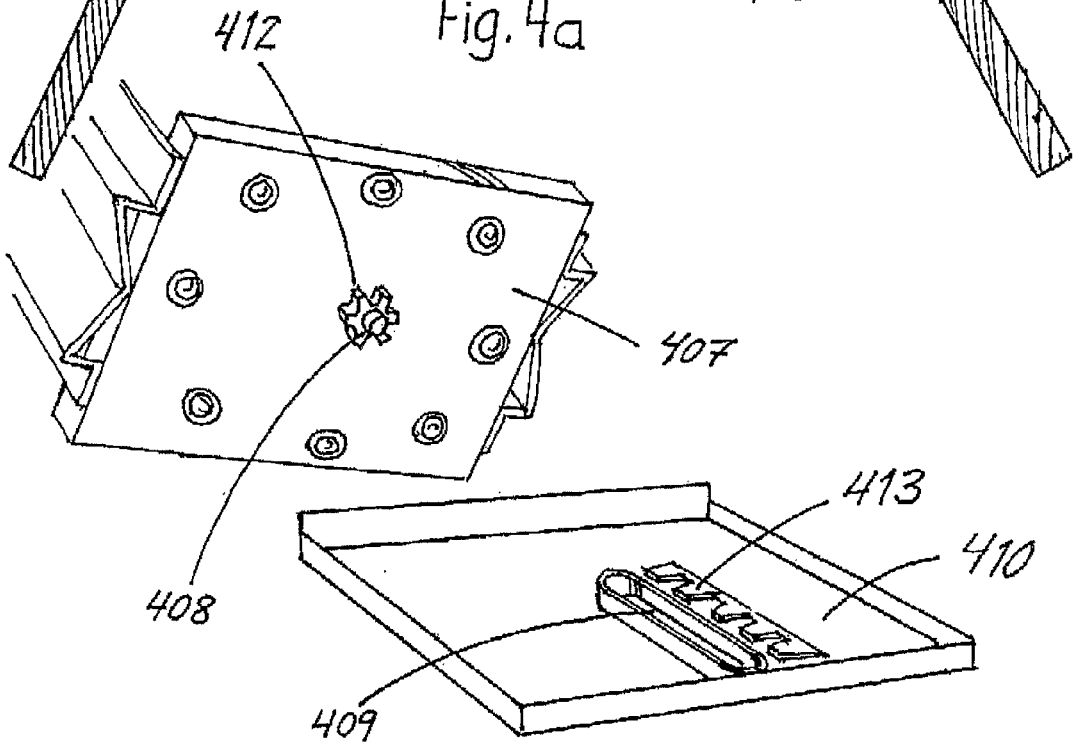
FIG. 4*b* shows details of the embodiment according to FIG. 4*a*.

A third embodiment of a shelf assembly 400 according to the invention is shown in FIG. 4. The shelf assembly 400 is placed in a cabinet 430. The shelf assembly 400 comprises a shelving section 401 with a front 401*a* and a rear 401*b*, which shelving section 401 comprises shelves 402 which are designed in the same way as the previously described shelves 102 or 302, a base plate 407 and a shelving section support 410. The shelving section 401 is rotatable about an axis 403 which extends through the shaft end 408 which is arranged on the base plate 407 and is engaged with a shaft seat 409 arranged on the shelving section support 410. The shaft seat 409 is formed as an elongate groove, see FIG. 4*b*, and therefore the shaft end 408 is movable. As a result, the axis of rotation 403, about which the shelving section 401 is rotatable, is movable.

Moreover, in this embodiment, an upper portion of the shaft end 408 is provided with a gear wheel 412. The teeth of the gear wheel 412 run in a gear rack 413 arranged on the shelving section support 410. On rotation of the shelving section 401 between the display position and the refill position, the teeth of the gear wheel 412 engage the gear rack 413, the respective gear rack positions of the gear wheel 412 corresponding to a predetermined movement of the axis of rotation 403, that is the position of the shaft end 408 in the shaft seat 409, in depth. In this embodiment, with the gear rack 413 arranged according to FIG. 4, the shelving section 401 is limited to be rotated counter-clockwise (seen from above) on rotation from the display position to the refill position. Correspondingly, the shelf assembly 401 is limited to clockwise rotation from the refill position back to the display position.

The pivot radius 404 of the shelving section 401 describes a circle 405 which in the lateral direction substantially coincides with the width of the space 430, but which in depth substantially falls outside the depth of the limited space 430. As described above, the axis of rotation 403 is movable along the extent of the shaft seat 409, and therefore the shelving section 401 is rotatable to the refill position by simultaneous movement of the position of the axis of rotation 403 in depth, towards the front edge 430*a* of the cabinet, the circle 405 being moved in the same direction and rotation of the shelving section 401 being made possible. In the refill position, the rear edge 401*b* of the shelving section is located a distance in front of the front edge 430*a* of the cabinet. Correspondingly, the shelving section 401 is rotatable from the refill position back to the display position with a reverse direction of rotation and movement of the shaft end 408 toward the rear boundary surface 430*c* of the limited space. The rear 401*b* of the shelving section is, in the refill position, further away from said rear boundary surface 430*c* than is the front 401*a* of the shelving section in the display position. The shelving section 401 is rotatable substantially within the limited space 430.

Figures 5A, 5B, 5C:
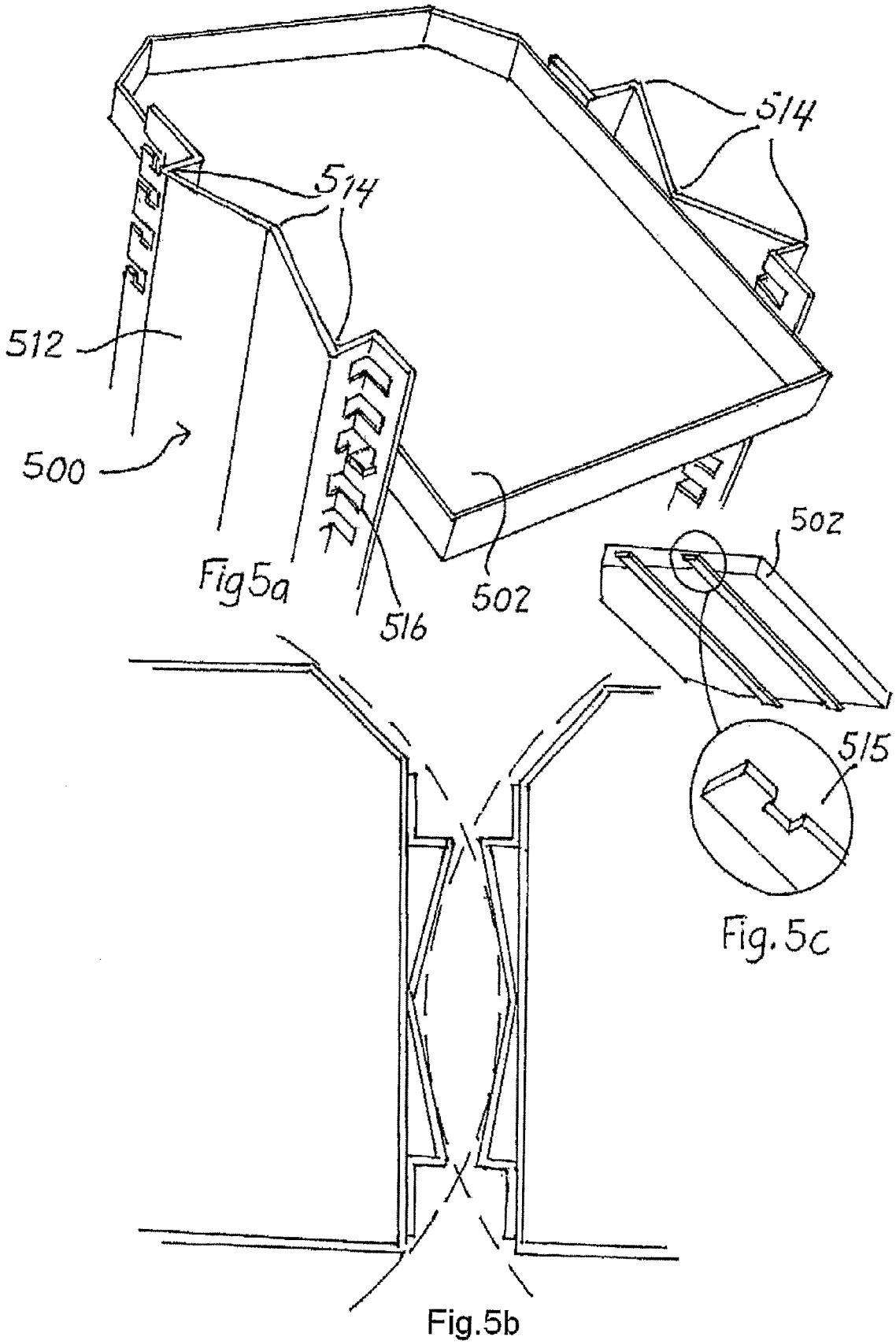
FIGS. 5*a* and *b* show folded lateral metal sheets and 5*c* a shelf attachment which is included in another embodiment of the shelf assembly according to the invention.

As shown in more detail in FIGS. 5*a*-5*b*, all embodiments of the shelf assembly advantageously have side walls 512 which are provided with bends 514. The bends 514 are rotation- and deflection-resistant and designed so that each side wall 512 is given a V-shaped or alternatively Σ-shaped bend along the longitudinal extent, thereby reinforcing the side walls 512. This significantly increases the stability of the shelf assembly 500, but involves additional advantages since the bends 514 also allow a simplified, optimal spacing of a plurality of shelf assemblies 500 side by side, see FIG. 5*b*, since the bends allow space for rotation of neighbouring shelf assemblies.

Recesses 516 are formed in the lateral plates 512 to attach shelves 502 by shelf attachments 515, as shown in FIG. 5*c*. This results in a flexible embodiment, in which the number of shelves 502 and their location can easily be adjusted as required.

The invention claimed is:

1. A sales products shelf assembly to be placed in a space, which at least is limited in depth by a rear boundary surface and laterally by lateral surfaces, the shelf assembly comprising:

a shelving section with a front and a rear, which shelving section comprises a plurality of spaced-apart gravity-feeding shelves, which are arranged above each other, the shelving section being rotatable about an axis of rotation between at least one display position, in which the shelves are accessible from the front of the shelving section, and a refill position, in which the shelves are accessible from the rear of the shelving section; and a shelving section support placed on a base;

wherein the shelving section comprises a base plate, and the shelving section is placed on the shelving section support; wherein the axis of rotation extends through a first engaging member which is arranged on the underside of the base plate and which is rotatably engaged with a second engaging member which is arranged on the upper side of the shelving section support;

wherein the shelving section further comprises side walls attached to the base plate and extending upwards therefrom, said side walls carrying the shelves, and wherein the axis of rotation is fixed relative to the shelves and relative to said rear boundary surface, and said rear of the shelving section in the refill position is located further away from said rear boundary surface than is said front of the shelving section in the display position, and said shelving section being rotatable substantially within said limited space.

2. A shelf assembly as claimed in claim 1, wherein the axis of rotation in the lateral direction is arranged substantially centrally while the axis of rotation in depth is arranged closer to the front of the shelving section than the rear of the shelving section, the axis of rotation substantially coinciding with the centre of a geometric circle, whose diameter corresponds to the width of the space and is tangent to the lateral surfaces and the rear boundary surface of the space, while the shelving section is rotatable in situ.

3. A shelf assembly as claimed in claim 2, wherein one or more rolling elements are arranged on at least one of the underside of the base plate and the upper side of the shelving section support.

4. A shelf assembly as claimed in claim 3, wherein the rolling elements are arranged substantially in a circle.

5. A shelf assembly as claimed in claim 1, wherein the shelves are inclined.

6. A shelf assembly as claimed in claim 1, wherein the shelves are provided with sliding surfaces.

7. A shelf assembly as claimed in claim 1, wherein the shelves are provided with channels for stabilising advanced products.

8. A shelf assembly as claimed in claim 1, wherein each of the side walls is a metal sheet, which metal sheet is provided with rotation- and deflection-resistant bends.

9. A shelf assembly as claimed in claim 1, wherein the shelves are designed based on a substantially rectangular shape, the rear outer corners of the shelves being trimmed for optimal adjustment of the shelving section in the limited space and for support of said rotatability.

10. A shelf assembly as claimed in claim 1, wherein the front edges of the shelves are straight.

11. A shelf assembly as claimed in claim 1, wherein the space has a width greater than its depth.

12. A refrigerator comprising a cabinet, which provides a space at least being limited in depth by a rear boundary surface and laterally by lateral surfaces, and a sales products shelf assembly; the shelf assembly comprising:

a shelving section with a front and a rear, which shelving section comprises a plurality of spaced-apart gravity-feeding shelves, which are arranged above each other, the shelving section being rotatable about an axis of rotation between at least one display position, in which the shelves are accessible from the front of the shelving section, and a refill position, in which the shelves are accessible from the rear of the shelving section; and a shelving section support placed on the base;

wherein the shelving section comprises a base plate, and the shelving section is placed on the shelving section support, wherein the axis of rotation extends through a first engaging means which is arranged on the underside of the base plate and which is rotatably engaged with a second engaging means which is arranged on the upper side of the shelving section support, wherein the axis of rotation is fixed relative to the shelves and relative to said cabinet; and said rear of the shelving section in the refill position is located further away from said rear boundary surface than is said front of the shelving section in the display position, and said shelving section being rotatable substantially within said limited space.

13. A shelf assembly as claimed in claim 1, wherein the side walls include a plurality of recesses arranged along a length of the side walls and each of the plurality of spaced-apart gravity-feeding shelves is provided with at least one locking element configured to engage with the recesses of the side walls so that the plurality of spaced-apart gravity-feeding shelves can be adjusted in a direction along the length of the side walls.

* * * * *